US007913764B2

(12) United States Patent
Smith et al.

(10) Patent No.: US 7,913,764 B2
(45) Date of Patent: Mar. 29, 2011

(54) RETURN LINE MOUNTED PUMP FOR RISERLESS MUD RETURN SYSTEM

(75) Inventors: David E. Smith, Houston, TX (US); Nils Lennart Rolland, Nyborg (NO); Harald Hufthammer, Straume (NO); Roger Stave, Bergen (NO)

(73) Assignee: AGR Subsea, Inc., Houston, TX (US)

( * ) Notice: Subject to any disclaimer, the term of this patent is extended or adjusted under 35 U.S.C. 154(b) by 637 days.

(21) Appl. No.: 11/833,010

(22) Filed: Aug. 2, 2007

(65) Prior Publication Data

US 2009/0032301 A1 Feb. 5, 2009

(51) Int. Cl.
*E21B 7/12* (2006.01)

(52) U.S. Cl. ..... 166/358; 166/345; 166/367; 175/5

(58) Field of Classification Search ..... 166/367, 166/358, 357, 350, 351, 345, 344; 175/5–10
See application file for complete search history.

(56) References Cited

U.S. PATENT DOCUMENTS

| | | | | |
|---|---|---|---|---|
| 3,603,409 | A * | 9/1971 | Watkins | 175/7 |
| 4,063,602 | A * | 12/1977 | Howell et al. | 175/7 |
| 4,091,881 | A * | 5/1978 | Maus | 175/7 |
| 4,149,603 | A | 4/1979 | Arnold | |
| 4,291,772 | A * | 9/1981 | Beynet | 175/5 |
| 4,535,851 | A * | 8/1985 | Kirkpatrick et al. | 175/38 |
| 4,813,495 | A * | 3/1989 | Leach | 175/6 |
| 5,488,993 | A * | 2/1996 | Hershberger | 166/372 |
| 6,142,236 | A | 11/2000 | Brammer et al. | |
| 6,179,057 | B1 * | 1/2001 | Fontana et al. | 166/363 |
| 6,216,799 | B1 * | 4/2001 | Gonzalez | 175/5 |
| 6,325,159 | B1 | 12/2001 | Peterman et al. | |
| 6,454,022 | B1 * | 9/2002 | Sangesland et al. | 175/7 |
| 6,457,529 | B2 * | 10/2002 | Calder et al. | 166/368 |
| 6,745,851 | B1 * | 6/2004 | Edvardsen | 175/5 |
| 6,843,331 | B2 * | 1/2005 | de Boer | 175/70 |

(Continued)

FOREIGN PATENT DOCUMENTS

WO 2005049958 A1 6/2005

OTHER PUBLICATIONS

PCT International Search Report, Feb. 6, 2009.

*Primary Examiner* — Thomas A Beach
(74) *Attorney, Agent, or Firm* — Conley Rose, P.C.

(57) ABSTRACT

Systems and methods for drilling a well bore in a subsea formation from an offshore structure positioned on a water surface with a drill string that is suspended from the structure and includes a bottom hole assembly adapted to form a top hole portion of the well bore. A drilling fluid source on the offshore structure supplies drilling fluid through the drill string to the bottom hole assembly where the drilling fluid exits from the bottom hole assembly during drilling and returns up the well bore. A suction module is disposed at the sea floor and collects the drilling fluid emerging from the well bore. A pump module is disposed on a return line, which is in fluid communication with the suction module, at a position below the water surface and above the sea floor. The pump module is operable to receive drilling fluid from the suction module and pump the drilling fluid through the return pipe to the same offshore structure or a different offshore structure.

16 Claims, 4 Drawing Sheets

U.S. PATENT DOCUMENTS

| | | | | |
|---|---|---|---|---|
| 6,966,367 | B2 * | 11/2005 | Butler et al. | 166/105 |
| 7,090,036 | B2 * | 8/2006 | deBoer | 175/70 |
| 7,264,058 | B2 | 9/2007 | Fossli | |
| 7,270,185 | B2 * | 9/2007 | Fontana et al. | 166/358 |
| 2001/0050185 | A1 | 12/2001 | Calder et al. | |
| 2003/0070840 | A1 * | 4/2003 | Boer | 175/5 |
| 2003/0170077 | A1 * | 9/2003 | Herd et al. | 405/224.2 |
| 2004/0031622 | A1 | 2/2004 | Butler et al. | |
| 2006/0065402 | A9 * | 3/2006 | Fontana et al. | 166/358 |
| 2008/0190663 | A1 * | 8/2008 | Stave | 175/7 |

* cited by examiner

RETURN LINE MOUNTED PUMP FOR RISERLESS MUD RETURN SYSTEM

CROSS REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION

Embodiments of the invention relate to riserless mud return systems used in the oil production industry. More particularly, embodiments of the invention relate to a novel system and method for riserless mud return using a subsea pump suspended along a rigid mud return line.

Top hole drilling is generally the initial phase of the construction of a subsea well and involves drilling in shallow formations prior to the installation of a subsea blowout preventer. During conventional top hole drilling, a drilling fluid, such as drilling mud or seawater, is pumped from a drilling rig down the borehole to lubricate and cool the drill bit as well as to provide a vehicle for removal of drill cuttings from the borehole. After emerging from the drill bit, the drilling fluid flows up the borehole through the annulus formed by the drill string and the borehole. Because, conventional top hole drilling is normally performed without a subsea riser, the drilling fluid is ejected from the borehole onto the sea floor.

When drilling mud, or some other commercial fluid, is used for top hole drilling, the release of drilling mud in this manner is undesirable for a number of reasons, namely cost and environmental impact. Depending on the size of the project and the depth of the top hole, drilling mud losses during the top hole phase of drilling can be significant. In many regions of the world, there are strict rules governing, even prohibiting, discharges of certain types of drilling fluid. Moreover, even where permitted, such discharges can be harmful to the maritime environment and create considerable visibility problems for remote operated vehicles (ROVs) used to monitor and perform various underwater operations at the well sites.

For these reasons, systems for recycling drilling fluid have been developed. Typical examples of these systems are found in U.S. Pat. No. 6,745,851 and W.O. Patent Application No. 2005/049958, both of which are incorporated herein by reference in their entireties for all purposes. Both disclose systems for recycling drilling fluid, wherein a suction module, or equivalent device, is positioned above the wellhead to convey drilling fluid from the borehole through a pipeline to a pump positioned on the sea floor. The pump, in turn, conveys the drilling fluid through a flexible return line to the drilling rig above for recycling and reuse. The return line is anchored at one end by the pump, while the other end of the return line is connected to equipment located on the drilling rig.

Positioning the pump on the sea floor requires that the pump be designed and manufactured to withstand hydrostatic forces commensurate with the depth of the sea floor. Also, positioning the pump on the sea floor may be undesirable in certain conditions due to the time needed to retrieve the pump in the event that the pump needs maintenance or bad weather occurs Thus, embodiments of the invention are directed to riserless mud return systems that seek to overcome these and other limitations of the prior art.

SUMMARY OF THE PREFERRED EMBODIMENTS

Systems and methods for drilling a well bore in a subsea formation from an offshore structure positioned at a water surface and having a drill string that is suspended from the structure and including a bottom hole assembly adapted to form a top hole portion of the well bore. A drilling fluid source on the offshore structure supplies fluid through the drill string to the bottom hole assembly where the fluid exits from the bottom hole assembly during drilling and returns up the well bore. A suction module is disposed at the sea floor and collects the fluid emerging from the well bore. A pump module is disposed on a return line, which is in fluid communication with the suction module, at a position below the water surface and above the sea floor. The pump module is operable to receive fluid from the suction module and pump the fluid through the return pipe to the same or a different offshore structure, Thus, embodiments of the invention comprise a combination of features and advantages that enable substantial enhancement of riserless mud return systems. These and various other characteristics and advantages of the invention will be readily apparent to those skilled in the art upon reading the following detailed description of the preferred embodiments of the invention and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
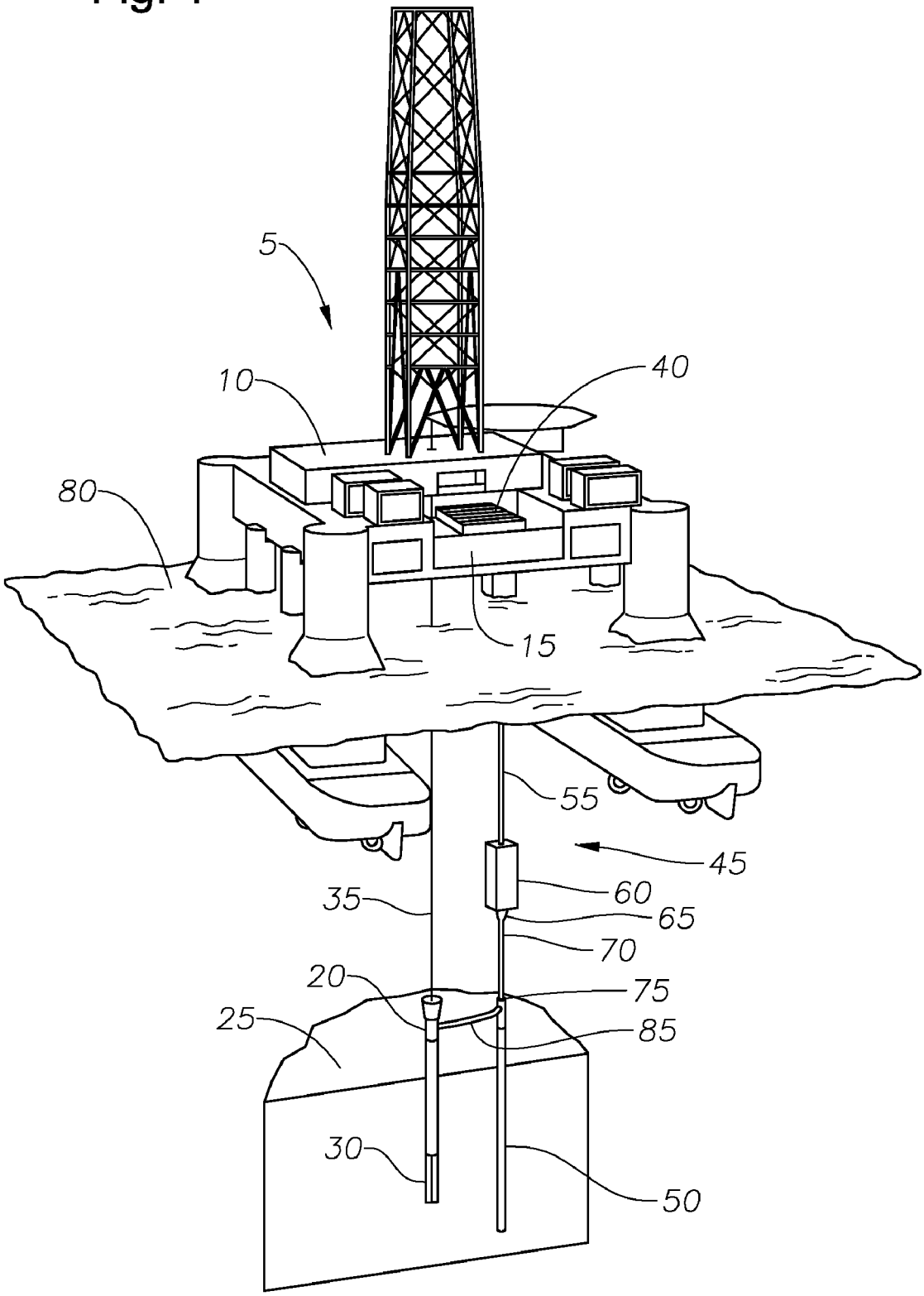
FIG. 1 is a schematic representation of a drilling rig with a riserless mud return system comprising a subsea pump suspended along a rigid mud return line in accordance with embodiments of the invention.

Various embodiments of the invention will now be described with reference to the accompanying drawings, wherein like reference numerals are used for like parts throughout the several views. The drawing figures are not necessarily to scale. Certain features of the invention may be shown exaggerated in scale or in somewhat schematic form, and some details of conventional elements may not be shown in the interest of clarity and conciseness.

Preferred embodiments of the invention relate to riserless mud return systems used in the recycling of drilling fluid. The invention is susceptible to embodiments of different forms. There are shown in the drawings, and herein will be described in detail, specific embodiments of the invention with the understanding that the disclosure is to be considered an exemplification of the principles of the invention and is not intended to limit the invention to that illustrated and described herein. It is to be fully recognized that the different teachings of the embodiments discussed below may be employed separately or in any suitable combination to produce desired results.

Referring now to FIG. 1, drilling rig, 5 includes drill floor 10 and moonpool 15. An example of an offshore structure, drilling rig 5 is illustrated as a semi-submersible floating platform, but it is understood that other platforms or structures may also be used. For example, offshore structures include, but are not limited to, all types of rigs, barges, ships, spars, semi-submersibles, towers, and/or any fixed or floating platforms, structures, vessels, or the like, Suction module 20 is positioned on the sea floor 25 above borehole 30. Drill string 35 is suspended from drill floor 10 through suction module 20 into borehole 30. Deployment and hang-off system 40 is disposed adjacent to moonpool 15 and supports the return string 45, which is secured to the sea floor 25 by anchor 50. Although this exemplary embodiment depicts return string 45 coupled to drilling rig 5, it is understood that, in other embodiments, return string 45 may be coupled to and supported by the same or another offshore structure and can return fluid to the same offshore structure as coupled to the drill string 35 or to a second offshore structure. Return string 45 further includes upper mud return line 55, pump module 60, docking joint 65, lower mud return line 70, and emergency disconnect 75.

Upper and lower mud return lines 55, 70 are both formed from pipe, such as drill pipe or other suitable tubulars known in the industry. Mud return lines 55, 70 are preferably formed from a series of individual lengths of pipe connected in series to form the continuous line. In preferred embodiments, mud return lines 55, 70 are rigid, having only inherent flexibility due to their long, slender shapes. As it is used herein, the term "rigid" is used to describe the mud return lines as being constructed from a material having significantly greater rigidity than the coiled tubing or flexible hose conventionally used in mud return lines. In other embodiments, mud return lines 55, 70 may be non-rigid or flexible, for example coiled tubing, flexible hose, or other similar structures.

Upper mud return line 55 is connected at its upper end to deployment and hang-off system 40 and at its lower end to docking joint 65, which is located below sea level 80. Pump module 60 is releasably connected to docking joint 65. Lower mud return line 70 runs from docking joint 65 and is secured to the sea floor by anchor 50. In certain embodiments, emergency disconnect 75 may releasably couple lower mud return line 70 to anchor 50. Suction hose assembly 85 extends from suction module 20 to lower mud return line 70 so as to provide fluid communication from the suction module to the mud return line.

Prior to initiating drilling operations, return string 45 is installed through moonpool 15. Installation of return string 45 includes coupling anchor 50 and emergency disconnect 75 (if desired) to lower mud return line 70. Anchor 50 is lowered to sea floor 25 by adding individual joints of pipe that extend the length of lower mud return line 70. As return string 45 is installed, docking joint 65 and upper mud return line 55 are added. Pump module 60 may be run with return string 45 or after the string has been completely installed. Upon reaching the sea floor 25, anchor 50 is installed to secure return string 45 to the sea floor 25. Return string 45 is then suspended from deployment and hang-off system 40 and drilling operations may commence.

During drilling operations, drilling fluid is delivered down drill string 35 to a drill bit positioned at the end of drill string 35. After emerging from the drill bit, the drilling fluid flows up borehole 30 through the annulus formed by drill string 35 and borehole 30. At the top of borehole 30, suction module 20 collects the drilling fluid. Pump module 60 draws the mud through suction hose assembly 85, lower mud return line 70, and docking joint 65 and then pushes the mud upward through upper mud return line 55 to drilling rig 5 for recycling and reuse. During operation, anchor 50 limits movement of return string 45 in order to prevent the return string from impacting other submerged equipment.

Figure 2A:
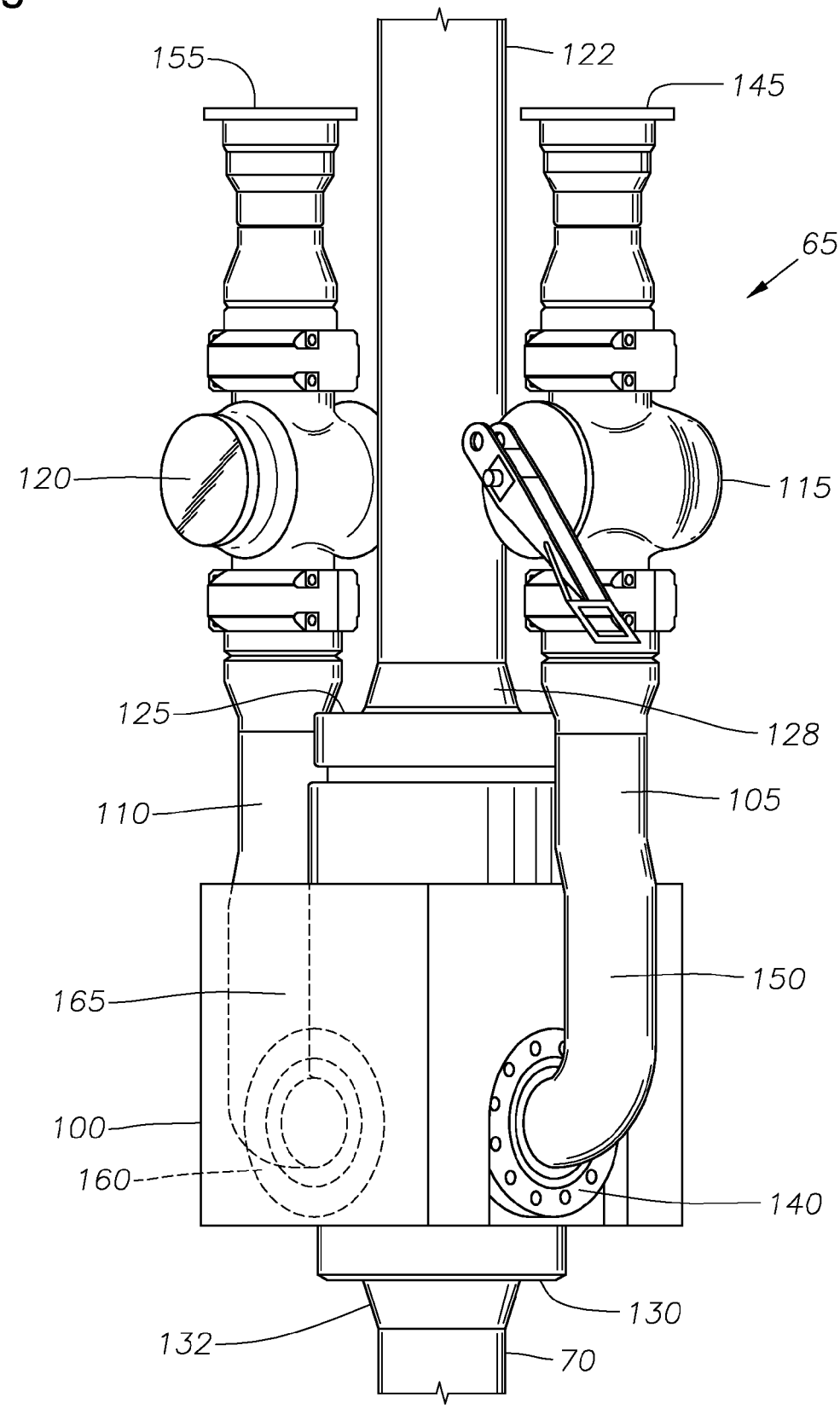
FIGS. 2A and 2B are schematic representations of the docking joint depicted in FIG. 1.
Figure 2B:
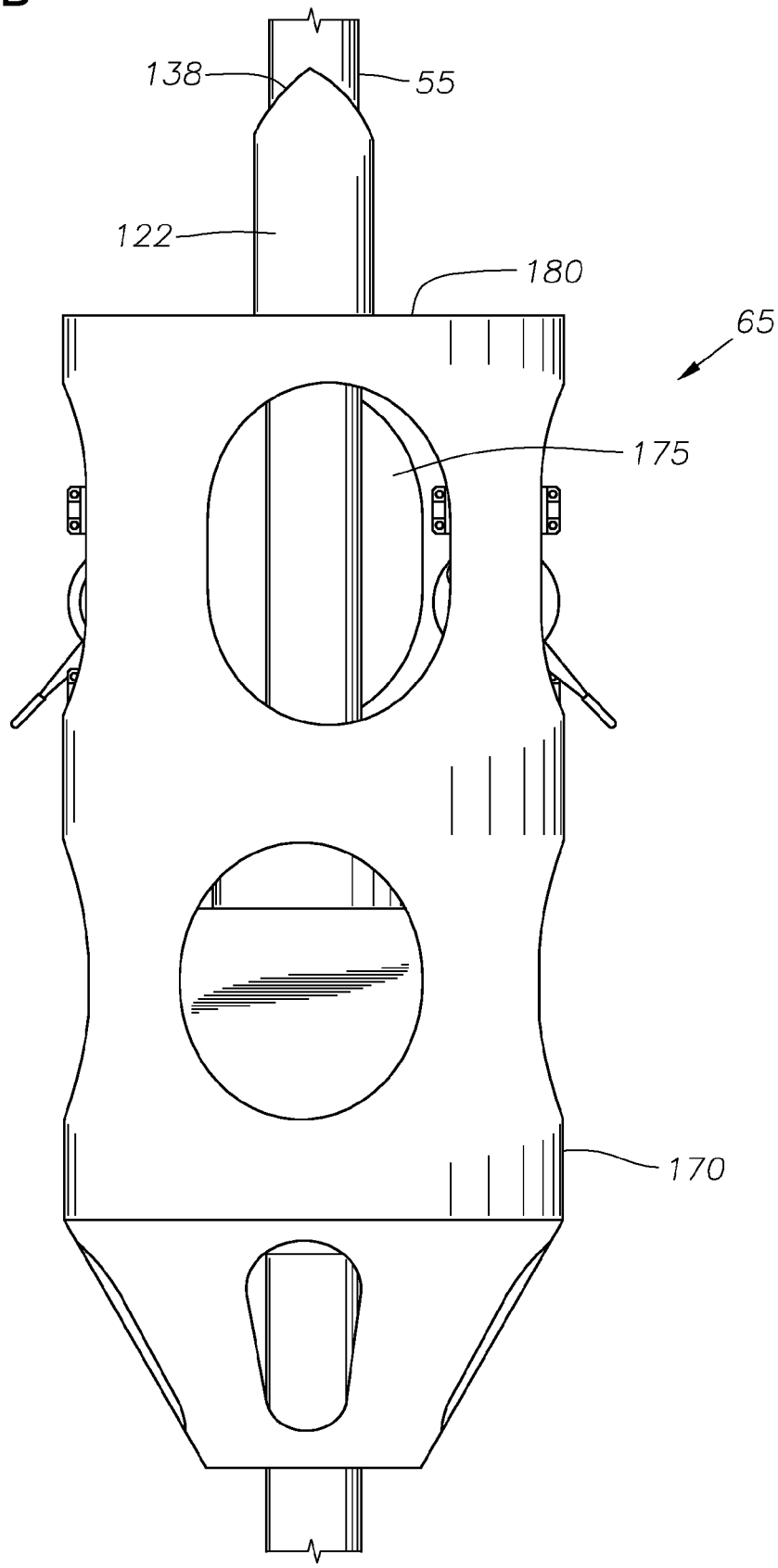

FIGS. 2A and 2B are schematic representations of one embodiment of a docking joint 65 as depicted in FIG. 1. As shown in FIG. 2A, docking joint 65 includes housing 100, inlet line 105, outlet line 110, isolation valves 115, 120, and upper connecting pipe 122. Housing 100 includes fluid outlet port 125 at its upper end 128 and a fluid inlet port 130 at its lower end 132. Housing 100 includes a first internal passage that provides fluid communication between fluid inlet port 130 and inlet line 105 and a second internal passage that provides fluid communication between outlet line 110 and fluid outlet port 125. Housing 100 may be formed from a single block of material or may be constructed from separate pieces as a fabricated assembly.

Inlet line 105 further includes inlet 140 that is coupled to housing 100, outlet 145 that connects to pump module 60, and flowbore 150 providing fluid communication therebetween. Similarly, outlet line 110 further includes inlet 155 that connects to pump module 60, outlet 160 coupled to housing 100, and a flowbore 165 providing fluid communication therebetween. Isolation valves 115, 120 are positioned along flowbore 150, 165, respectively, in order to selectively allow fluid communication along inlet line 105 and outlet line 110.

Mud return line 70 is coupled to housing 100 at lower end 132 via a threaded connection or other suitable type of connection. Upper connecting pipe 122 couples mud return line 55 to housing 100 at upper end 128 via threaded connections or other suitable type of connections known in the industry. Referring now to FIG. 2B, connecting pipe 122 further includes helix 138, which is configured to align pump module 60 with docking joint 65. Cover 170 provides a surface 180 on which pump module 60 is seated when pump module 60 is installed. Cover 170 further includes cut-outs 175, which permit pump module 60, when installed, access to isolation valves 115, 120, inlet line 105 and outlet line 110.

Figure 3:
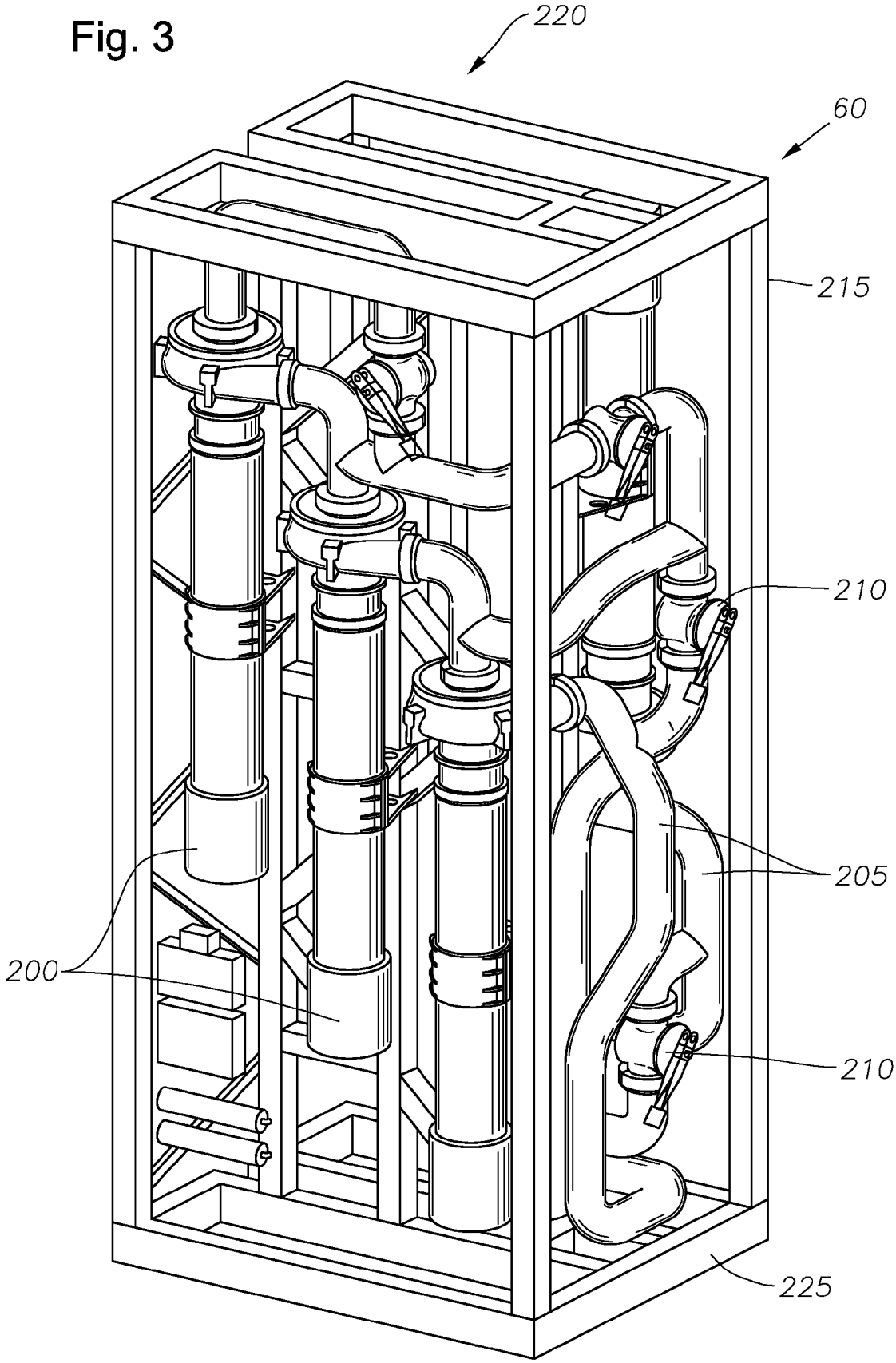
FIG. 3 is a schematic representation of the subsea pump module depicted in FIG. 1.

FIG. 3 illustrates one embodiment of a subsea pump module 60 that is operable to interface with docking joint 65, as shown in FIGS. 2A and 2B. Pump module 60 includes pump assemblies 200, flowlines 205, and isolation valves 210, all assembled and contained within frame 215. Pump assemblies 200 are arranged in series so that flowlines 205 provide fluid communication through pump module 60 that allows fluid from return line 70 to be successively pressurized by each pump assembly 200. Valves 210 allow for the flow to be directed to the pump assemblies 200 as desired for a particular application. Pump assemblies 200 are illustrated as disc or, alternatively, centrifugal pump units but it is understood that any type of pump can be used in pump module 60. Power for pump-motor assemblies 200 may be provided by electrical wiring from drilling rig 5. In some embodiments, isolation valves 210 may be electrically actuated also via electrical wiring from drilling rig 5. Additionally, isolation valves 210 may be manually actuated during operations involving ROVs.

Frame 215 protects pump assemblies 200 and their piping components and provides attachment points for lifting pump module 60 and facilitating the installation and retrieval of the module. Frame 215 includes an opening 220, which permits pump module 60 to be inserted over mud return line 55 (see FIGS. 1 and 2A) and lowered along mud return line 55 to docking joint 65 during installation. Frame 215 is also configured to interface with helix 138 so as to align pump module 60 with docking joint 65 during installation of the pump module.

As described above in reference to FIG. 1, docking joint 65 is installed with mud return lines 70, 55 to form return string 45. Prior to the installation of pump module 60, isolation valves 115, 120 on lines 105, 110 of docking joint 65 may be closed to prevent circulation of seawater into return string 45. Pump module 60 may then be installed along return string 45 with docking joint 65 or independently of docking joint 65.

During normal deployment procedures, pump module 60 may be installed with docking joint 65. In this scenario, pump module 60 is coupled to docking joint 65 and the two components are then lowered to the desired depth. To enable these procedures, docking joint 65 is designed to allow pick-up of pump module 60 without breaking return string 45. Installation of pump module 60 with docking joint 65 in this manner is less time consuming than conventional methods because it is not necessary to break return string 45. Retrieval of pump module 60 using docking joint 65 is also more efficient for this same reason.

Alternatively, during maintenance and/or emergency procedures, pump module 60 may be installed independently of docking joint 65. For example, when pump module 60 requires maintenance and/or bad weather approaches, it may be necessary to retrieve pump module 60 while return string 45, including docking joint 65, remains in place. After maintenance of pump module 60 is completed or the bad weather has passed, pump module 60 may be lowered along return line 55 to engage docking joint 65.

In either scenario, installation of pump module 60 preferably includes inserting mud return line 55 into opening 220 and lowering pump module 60 over the mud return line 55 to docking joint 65. As pump module 60 is lowered over connecting line 122 of docking joint 65, pump module 60 engages helix 138, causing pump module 60 to rotate as pump module 60 descends toward docking joint 65 such that when pump module is seated on docking joint 65, pump module 60 is aligned with cover 170 and engaged with inlet line 105 and outlet line 110. Aligning pump module 60 with cover 170 allows pump module 60 access, via cut-outs 175, to isolation valves 115, 120.

In some embodiments, seating pump module 60 on docking joint 65 automatically actuates isolation valves 115, 120 from closed positions to open positions. Conversely, unseating pump module 60 from cover 170 of docking joint 65 actuates isolation valves 115, 120 to closed positions. In other embodiments, seating and unseating of pump module 60 in this manner may not actuate isolation valves 115, 120. Rather, a signal transmitted to the isolation valves 115, 120 from a remote location, erg drilling rig 5, actuates isolation valves 115, 120. Additionally, isolation valves 115, 120 may be manually actuated during operations involving ROVS.

After pump module 60 is installed and isolation valves 115, 120 are opened, a fluid flowpath is established through pump module 60. Once pump module 60 is operational and top hole drilling operations begin, drilling fluid is permitted to flow from mud return line 70 into docking joint 65 through fluid inlet port 130. The drilling fluid then passes through inlet line 105, entering at inlet 140 and exiting at outlet 145. Upon exiting inlet line 105, the drilling fluid flows through pump module 60 to outlet line 110 at inlet 155. After exiting bypass line 110 through outlet 160, the drilling fluid then flows from docking joint 65 through fluid exit port 125, upward through connecting line 122, and into mud return line 55.

As described above, top hole drilling operations may commence after pump module 60 is installed. While operational, pump assemblies 200 of pump module 60 draw drilling fluid from the suction module 20 through suction hose assembly 85, mud return line 70, and bypass line 110 of docking joint 65. Pump-motor assemblies 200 preferably then push the mud through flowlines 205, through bypass line 110 of docking joint 65, and upward through return line 55 to drilling rig 5 for recycling and reuse. Isolation valves 210 are actuated, as needed, to direct the flow of the drilling fluid through flowlines 205 and back into docking joint 65.

In the event that pump module 60 requires maintenance and/or bad weather occurs necessitating the retrieval of pump module 60, drilling operations cease. The flow of drilling fluid through pump module 60 is discontinued, and isolation valves 115, 120 are actuated to closed positions. Pump module 60 is then disengaged from docking joint 65 and returned to drill floor 10 of drilling rig 5, either for maintenance or safe stowage. Closure of isolation valves 115, 120 prevents drilling fluid from dispersing into the surrounding water after pump module 60 is disengaged from docking joint 65.

Retrieval of pump module 60 in this manner is expedited for at least two reasons. First, pump module 60 may be disengaged from docking joint 65 without the need to break the return string 45. Second, pump module 60 is suspended above the sea floor 25, rather than seated on it. Once maintenance has been performed on pump module 60 and/or bad weather has passed, pump module 60 may be redeployed by lowering pump module 60 along return string 45 to docking joint 65 where, again, pump module 60 engages docking joint 65, as described above. Subsequent redeployment of pump module 60 is also expedited for these same reasons.

The terms "couple," "couples," and "coupled" and the like include direct connection between two items and indirect connections between items.

While preferred embodiments have been shown and described, modifications thereof can be made by one skilled in the art without departing from the scope or teachings herein. The embodiments described herein are exemplary only and are not limiting. Many variations and modifications of the systems are possible and are within the scope of the invention. For example, the relative dimensions of various parts, the materials from which the various parts are made, and other parameters can be varied. In particular, the subsea pump module may comprise fewer or more pump-motor assemblies as needed to convey drilling fluid from the suction module through the return string to the drilling rig. Accordingly, the scope of protection is not limited to the embodiments described herein, but is only limited by the claims that follow, the scope of which shall include all equivalents of the subject matter of the claims.

What is claimed is:

1. A method for drilling offshore, comprising:

driving a bit to form a well bore in a subsea formation, said bit being coupled to a drill string;

injecting a drilling fluid into the drill string from a first offshore structure located at a water surface;

collecting the drilling fluid with a suction module after the drilling fluid passes through the drill string;

providing fluid communication along a fluid flow path between the suction module and the water surface through a return conduit and a docking joint coupled thereto;

releasably connecting a pump module to the docking joint after said providing, the pump module having a pump assembly operable to pressurize fluid passing therethrough; and diverting the drilling fluid from the fluid flow path through the pump module back to the fluid flow path, whereby the drilling fluid in the return riser is lifted.

2. The method of claim 1, further comprising isolating the pump module from the return riser.

3. The method of claim 2, further comprising retrieving the pump module to the first offshore structure without retrieving the return riser.

4. The method of claim 1, further comprising:

suspending the return riser from the first offshore structure.

5. The method of claim 1, wherein said return riser is rigid.

6. The method of claim 1, further comprising suspending the return riser from a second offshore structure.

7. The method of claim 2, wherein said isolating comprises actuating isolation valves, whereby said lifting ceases.

8. The method of claim 6, further comprising retrieving the pump module to the second offshore structure without dismantling the return riser.

9. A riser system for returning drilling fluid from a wellbore to an offshore structure, the riser system comprising:

a return riser having a lower portion in fluid communication with the wellbore and an upper portion in fluid communication with the offshore structure;

a docking joint coupled between the upper and lower portions of said return riser; and a pump module adapted for releasable coupling to said docking joint;

wherein, when said pump module is disengaged from said docking joint, a first fluid path is established from the lower portion of said return riser through said docking joint to the upper portion of said return riser, the first fluid path bypassing the pump module; and wherein, when said pump module is releasably coupled to said docking joint, a second fluid path is established from the lower portion through said docking joint and said pump module to the upper portion.

10. The riser system of claim 9, wherein said pump module comprises a frame that partially surrounds said return riser and is operable to engage said docking joint.

11. The riser system of claim 9, wherein said docking joint comprises a helix that aligns said pump module with said docking joint.

12. The riser system of claim 9, wherein said pump module further comprises:

an inlet operable to couple to said docking joint;

a pump in fluid communication with said inlet; and an outlet in fluid communication with said pump and operable to couple to said docking joint.

13. The riser system of claim 9, wherein the return riser is rigid.

14. The riser system of claim 9, wherein said docking joint comprises isolation valves that are operable to isolate said pump module from said return riser.

15. The riser system of claim 9, further comprising an anchor secured to the sea floor and an emergency disconnect coupled between the anchor and the lower portion of the return riser.

16. The riser system of claim 9, further comprising a suction module mounted over the wellbore in sealed relation to surrounding seawater and a suction hose assembly coupled between the suction module and the lower portion of the return riser.

* * * * *